United States Patent [19]

Deter

[11] 4,237,525

[45] Dec. 2, 1980

[54] ILLUMINATED JEWELRY

[76] Inventor: Arthur R. Deter, P.O. Box 1864, Anderson, S.C. 29621

[21] Appl. No.: 932,932

[22] Filed: Aug. 11, 1978

Related U.S. Application Data

[63] Continuation of Ser. No. 815,438, Jul. 13, 1977, abandoned.

[51] Int. Cl.[3] ..... F21L 15/08

[52] U.S. Cl. ..... 362/104; 362/800

[58] Field of Search ..... 362/103, 104, 105, 800

[56] References Cited

U.S. PATENT DOCUMENTS

| | | | |
|---|---|---|---|
| 2,546,945 | 3/1951 | Gaffield | 362/104 |
| 3,384,740 | 5/1968 | Wood | 362/104 |
| 3,737,647 | 6/1973 | Gomi | 362/800 |
| 3,814,926 | 6/1974 | Frasca | 362/104 |
| 3,866,035 | 2/1975 | Richey | 362/104 |
| 3,968,357 | 7/1976 | Hamilton | 362/104 |

FOREIGN PATENT DOCUMENTS

| | | | |
|---|---|---|---|
| 950409 | 2/1964 | United Kingdom | 362/104 |

*Primary Examiner*—Donald P. Walsh

*Attorney, Agent, or Firm*—Fisher, Christen & Sabol

[57] ABSTRACT

Illuminated jewelry, such as an earring, is disclosed having a light emitting diode (LED) attached to a hearing aid type battery and a clip or like structure for attaching the jewelry to the wearer. The LED is attached to the battery by soldering the anode lead to the positive terminal and forming the cathode lead in such a manner that it bears against the negative battery terminal. The LED is thus normally on, and is turned off by inserting an insulating storage card between the cathode lead and the negative terminal.

7 Claims, 3 Drawing Figures

ILLUMINATED JEWELRY

This is a continuation of application Ser. No. 815,438, filed July 13, 1977, now abandoned.

FIELD OF THE INVENTION

This invention relates to illuminated jewelry, more specifically, jewel having a battery powered light emitting diode.

BRIEF DESCRIPTION OF THE PRIOR ART

Illuminated jewelry, such as an earring, is known, but has not achieved wide commercial success due to the complex structure and resultant unreliability. Earrings must be reasonably small and relatively light weight to allow a wearer to wear them comfortably for long periods of time. Such parameters have thwarted past inventors in their search to provide illuminated earrings since batteries and light bulbs were either too big and bulky, or, if made sufficiently small and light weight, were too short lived to be commercially practicable. Also, their small size made it extremely difficult to provide the necessary switching means to turn off the illumination when the earring was not in use.

Typical prior art illuminated earrings are shown in U.S. Pat. Nos. 2,546,945; 3,624,384; and 3,968,357. The earrings shown by these patents all use batteries in conjunction with an incandescent light bulb to provide the illumination, and suffer from the drawbacks previously discussed.

SUMMARY OF THE INVENTION

The present invention relates to illuminated jewelry, specifically an earring, which is simple in construction, reliable in operation, and low in cost. These objectives are achieved by providing a miniature battery, such as a hearing aid battery or the like, having affixed thereto means for attachment to the wearer and a light source, such as a light emissive diode. The attachment means may be a post and clasp, for use with pierced ears, or a screw-type clip.

The light emissive diode (LED) is attached to the battery by soldering its anode lead to the positive terminal and bending its cathode lead such that it is biased into contact with the negative battery terminal. Thus, the electric circuit is normally closed so as to "light" the LED. To turn off the LED, a thin piece of insulating material, such as paper, cardboard, plastic, or the like is inserted between the cathode lead and the negative battery terminal. It is envisioned that this insulating material will be part of a display or storage card on which the earrings may be placed when not in use.

DETAILED DESCRIPTION OF THE PREFERRED EMBODIMENT

The illuminated jewelry according to the present invention will be described in the configuration of an earring, although it is understood that the concepts are readily applicable to other forms of jewelry such as pins, rings, bracelets, cuff links, etc.

Figure 1:
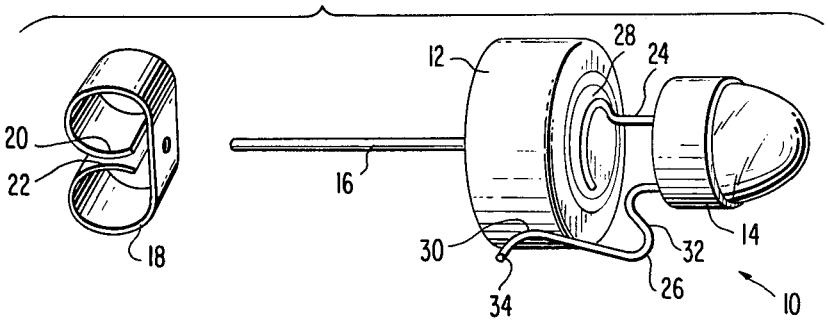
FIG. 1 is a perspective view of an illuminated earring according to the invention.

An earring 10 is shown in FIG. 1, comprising a miniature battery 12, a light emitting diode (LED) 14, earring post 16 and clasp 18. Earring post 16 and clasp 18 are standard commercially available items and serve to retain the earring on the wearer's pierced ears by inserting post 16 through the pierced lobe and sliding clasp 18 over post 16 behind the ear. Clasp 18 is frictionally retained in place by the force of portions 20 and 22 bearing against post 16. Post 16 is attached to battery 12 by soldering, glueing or the like.

LED 14, has anode lead 24 and cathode lead 26, which must contact battery 12 in order for LED 14 to function. Anode lead 24 is fixedly attached to positive terminal 28 of battery 12 by soldering or the like. Cathode lead 26 is formed in such a manner that portion 30 bears against the negative battery terminal which, in the instant case, is the outer periphery of battery 12. This can be accomplished by bending cathode lead 26 in a generally "S" shape, as at 32, such that portion 30 is biased against the battery. Cathode lead 26 has a certain amount of inherent resiliency which serves to maintain electrical contact between it and battery 12. Obviously, the lead may be bent in any other shape which will bias portion 30 against battery 12. Cathode lead 26 also has end portion 34 bent away from battery 12, the function of which will be described hereinafter.

Figure 2:
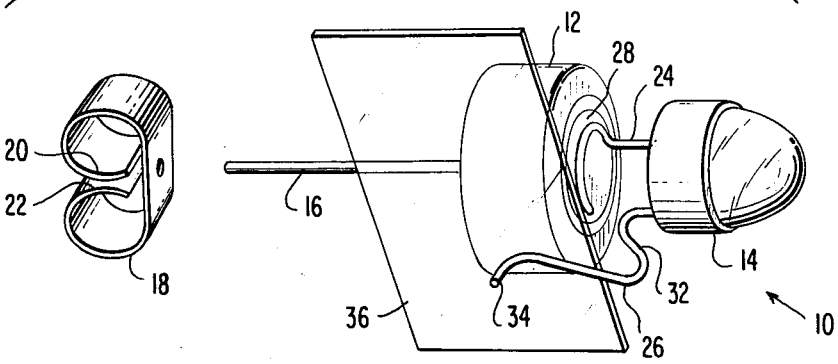
FIG. 2 is a perspective view of the earring of FIG. 1 with the light emissive diode turned off.

As can be seen from the foregoing description, LED 14 is normally "on" and means must be provided to turn it "off" when it is not being worn to prevent rapid battery wear. LED 14 is turned "off" by inserting a thin, non-conductive material 36 between battery 12 and cathode lead 26, as shown in FIG. 2. This material may be paper, plastic or similar material which may also be formed to provide storage or display means for the earrings. End portion 34 of cathode lead 26 facilitates insertion of material 36 without snagging or permanently deforming lead 26.

Figure 3:
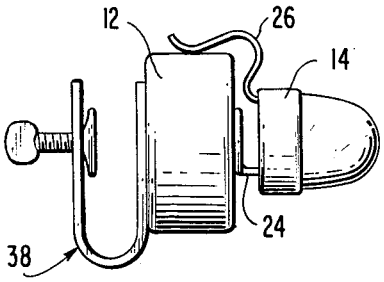
FIG. 3 is a side view of an alternative embodiment of an illuminated earring according to the invention.

Although the invention has been described in the form of an earring for pierced ears, a clip-on type earring fastener may be substituted for the post and clasp without exceeding the scope of this invention. As shown in FIG. 3, the "U" portion of clip 38 may be attached to battery 12 by glueing, soldering or the like. Clip 38 may be the screw-on type, as shown, or the spring clip type wherein the rear portion of the clip is spring biased against the rear portion of the wearers ear lobe.

The basic embodiment of the invention, the battery, LED, and switching means, may as be incorporated in other forms of jewelry such as cuff links, pins, rings, bracelets, etc.

I claim:

1. Illuminated jewelry comprising:

(a) a battery having a positive terminal and a negative terminal;

(b) a light emissive diode mounted on said battery and having a first lead mounted on and electrically connected to one said terminal of said battery so as to provide support for said light emissive diode and a second lead resiliently biased against the other said terminal of said battery, said second lead making interruptible contact with said other terminal; and (c) attachment means mounted on said battery for attaching said illuminated jewelry including said light emissive diode and said battery to a wearer.

2. Illuminated jewelry as claimed in claim 1 wherein said jewelry is an earring.

3. The illuminated jewelry as claimed in claim 1 wherein said first lead is electrically connected to the anode of said light emitting diode, the terminal of said battery on which said first lead is mounted is the positive terminal, said second lead is electrically connected to the cathode of said light emitting dioxide and the terminal against which said second lead is resiliently biased is the negative terminal.

4. The illuminated jewelry as claimed in claim 1 further comprising insulating means selectively and removably insertable between the negative terminal of the battery and said second lead of the light emitting diode to prevent electrical contact therebetween, thereby breaking the electrical circuit and turning off said light emitting diode.

5. The illuminated earring as claimed in claim 1 wherein said attachment means comprises:

(a) an elongate post having one end mounted on said battery and configured to extend through an opening in a pierced ear lobe; and (b) clasp means engageable with said post so as to retain the earring on the pierced ear lobe of wearer.

6. The illuminated earring as claimed in claim 1 wherein said attachment means comprises a generally "U" shaped clip, said clip having one leg of the "U" mounted on said battery and the other leg having means mounted thereon to grip the ear lobe of the wearer against said first leg of the "U".

7. The illuminated earring of claim 2 wherein said second lead is generally "S" shaped.

* * * * *